US007364047B2

(12) United States Patent
Michalsky

(10) Patent No.: US 7,364,047 B2
(45) Date of Patent: Apr. 29, 2008

(54) TUBULAR, ESPECIALLY CAN-SHAPED, RECEPTACLE FOR THE ACCOMMODATION OF FLUIDS, A METHOD OF MANUFACTURE, AND USE

(75) Inventor: Andreas Michalsky, Memmingen (DE)

(73) Assignee: Zweigniederlassung der Huhtamaki Deutschaland, GmbH & Co. KG, Ronsberg-Allgau (DE)

( * ) Notice: Subject to any disclaimer, the term of this patent is extended or adjusted under 35 U.S.C. 154(b) by 0 days.

(21) Appl. No.: 10/856,421

(22) Filed: May 27, 2004

(65) Prior Publication Data

US 2005/0262813 A1 Dec. 1, 2005

(51) Int. Cl.
*B65D 1/40* (2006.01)
*B65D 3/22* (2006.01)
*B65D 8/04* (2006.01)

(52) U.S. Cl. ..... 220/62.12; 220/613

(58) Field of Classification Search ..... 220/62.12, 220/62.22, 678, 703, 610–613
See application file for complete search history.

(56) References Cited

U.S. PATENT DOCUMENTS

| | | | | |
|---|---|---|---|---|
| 2,626,647 | A * | 1/1953 | Barton | 222/215 |
| 4,541,546 | A * | 9/1985 | Imazu et al. | 220/678 |
| 4,997,661 | A * | 3/1991 | Kromer et al. | 426/126 |
| 5,263,606 | A * | 11/1993 | Dutt et al. | 220/613 |
| 5,913,449 | A * | 6/1999 | Branch et al. | 220/677 |
| 5,939,153 | A * | 8/1999 | Valyi | 428/1.55 |
| 6,050,451 | A | 4/2000 | Hess, III et al. | |
| 6,123,211 | A * | 9/2000 | Rashid et al. | 215/12.1 |
| 6,270,867 | B1 | 8/2001 | Eckstein et al. | |
| 6,399,014 | B1 * | 6/2002 | Hermodsson | 264/515 |
| 2001/0042757 | A1 | 11/2001 | Kuge et al. | |
| 2002/0162863 | A1 * | 11/2002 | Brincat | 222/568 |
| 2002/0182351 | A1 * | 12/2002 | Akiyama et al. | 428/35.7 |

FOREIGN PATENT DOCUMENTS

| | | |
|---|---|---|
| DE | 3208625 | 10/1982 |
| EP | 0595587 | 5/1994 |
| EP | 0833774 | 4/1998 |
| JP | 2000006999 | 1/2000 |
| JP | 2001 080650 | 3/2001 |
| WO | WO 99/64227 | 12/1999 |
| WO | WO 00/00396 | 1/2000 |
| WO | WO 00/49908 | 8/2000 |
| WO | WO 00/50314 | 8/2000 |

OTHER PUBLICATIONS

Mexican Office Action dated Aug. 7, 2007.

* cited by examiner

*Primary Examiner*—Anthony D. Stashick
*Assistant Examiner*—Harry A Grosso
(74) *Attorney, Agent, or Firm*—Knobbe Martens Olson & Bear LLP

(57) ABSTRACT

Tubular, especially can-shaped, receptacle for the accommodation of fluids, especially drinks, with a tubular body and a base and top section attached to this, wherein the top section is constructed in the shape of a shoulder and is suitable for attaching a closure device, especially a resealable one. The shoulder-shaped top section is at least partially enclosed, especially in the shape of a shoulder, by an upper edge of the tubular body and sealed with this.

9 Claims, 1 Drawing Sheet

TUBULAR, ESPECIALLY CAN-SHAPED, RECEPTACLE FOR THE ACCOMMODATION OF FLUIDS, A METHOD OF MANUFACTURE, AND USE

BACKGROUND OF THE INVENTION

1. Field of the Invention

The invention concerns a tubular, especially can-shaped, receptacle for the accommodation of fluids, a method of manufacture, and a use of the receptacle.

2. Description of the Related Art

A large number of tubular receptacles are known from the prior art. These normally serve to accommodate pastes, creams, gels and fluids. The tubular receptacles are usually tube-shaped, though in recent times they are also can-shaped. DE 32 08 625 A1 and DE 44 29 148 A1 describe processes for manufacturing and filling such tubes. JP 2001 080 650 A describes a pouch-shaped receptacle with a base. A can-shaped tubular receptacle is described, for instance, in WO 99/64227. A series of other can-shaped tubular receptacles can be found in the publications EP 0 595 587 B1, EP 0 833 774 B1, WO 00/00396 and F1 109 193 B.

All these tubular receptacles described in the publications have certain disadvantages, especially with regard to their use. Use is therefore restricted and only possible for select products. Thus bag-type packaging, and tubes especially, have only limited use or are not suitable at all to accommodate fluids. In addition, tubes have no base that can serve as a standing surface. Another essential disadvantage, which all the aforementioned tubular receptacles have in common, consists in the fact that the said receptacles are not suitable for accommodating, and especially storing and transporting, nor for deliberately dispensing, drinks, especially carbonated drinks.

Hitherto, bottles and cans made out of aluminum or tinplate have normally been used for this purpose. These do have a high degree of impermeability, especially pressure tightness, and with that the facility for storing fluids that are under excess pressure. However, they are both expensive to manufacture and disadvantageous in terms of their weight and disposal.

SUMMARY OF THE INVENTION

One aim of the invention is to provide a tubular, especially can-shaped, receptacle for the accommodation of fluids, which is suitable for accommodating and storing fluids that are under slight excess pressure, such as carbonated drinks.

The aim may be achieved by a tubular, especially can-shaped, receptacle for the accommodation of fluids, especially drinks, with a tubular body and a base and top section attached to this, wherein the top section is constructed in the shape of a shoulder and is suitable for attaching a closure device, especially a resealable one.

One aspect of the invention lies in the fact that the top section is constructed in the shape of a shoulder. This makes it possible, on the one hand, to lay the top section flat against the circumferential tubular body and to seal it to it. On the other hand, the shoulder-shaped construction may create a junction with a closure device, which has an increased pressure-bearing capacity vis-a-vis the prior art. The shoulder-shaped construction of the top section also provides, compared with a level top section, a greater contact area both with the tubular body and for attaching a closure device. As a result, there is a greater sealing surface available between the shoulder-shaped top section and the tubular body, as well as between the shoulder-shaped top section and the closure device, thereby achieving an increase in stability and thus in the compressive strength of the receptacle.

The closure device is preferably constructed to be resealable, making it possible to remove only part-quantities of the volume from the tubular receptacle and to then close this again after removal. The closure device is preferably constructed in such a way that any excess pressure that is present can be reduced in a slow and controlled manner, say by means of a screw-type closure.

In one embodiment of the invention, the shoulder-shaped top section is at least partially enclosed, especially in the shape of a shoulder, by an upper edge of the tubular body and sealed with this. This embodiment has the decisive advantage that any excess pressure present or developing in the tubular receptacle helps to stabilize seal seams in a shoulder area. The excess pressure works on this occasion on the inner surface of the shoulder-shaped top section, pressing the top section against the edge of the tubular body enclosing the shoulder-shaped top section. The tubular body is preferably made of a flexible material. This, however, has an intrinsic firmness, possibly including a fabric or metallic or similar interlining, with the result that a shoulder of the top section may be pressed against a shoulder of the tubular body. A seal located in this area between the top section and the tubular body is consequently further reinforced by the added exertion of an inner pressure in the tubular receptacle, which in turn creates an additional sealing effect.

In some embodiments, the base section may be constructed as an especially dimensionally stable round section and may be sealed with a lower edge of the tubular body. In particular, the base section may be enclosed in a ring by the lower edge of the tubular body and sealed with this. The tubular body has according to one embodiment a round "standing surface", into which the base section is inserted and which, with respect to its shape, essentially corresponds to the circumferential shape of the base section. It is also possible that the tubular body is constructed with one or more corners or is oval. In each case the shape of the base section is adapted to the shape of the standing surface, the result being that the base section can be inserted in at least a lower edge of the tubular body and thereby seals the tubular body at the bottom.

The base section may have an edge area, which essentially runs parallel to the lower edge of the tubular body. The edge area serves as a sealing edge and preferably has a width extending horizontally to the circumference in the range of 0.1 mm to 10 mm, preferably 0.25 mm to 5 mm and, above all, preferably 0.4 mm to 0.6 mm.

The tubular body may be manufactured from at least a two-ply laminate, which has at least one barrier coating. In one embodiment of the invention, the layer of the laminate facing one inner side of the receptacle is constructed as a sealing layer and, in the instance of at least a three-ply laminate, a layer of the laminate facing one outer side of the receptacle is constructed as a printable and/or sealable layer. This enables the tubular body to be formed by an initially plane laminate being closed by means of a sealing seam, preferably a lap-seal seam to form a tubular body.

According to one variant of the invention, it is envisaged that the tubular body is formed from the plane laminate in such a way that a fin seal seam is constructed, preferably on at least one side of the tubular body. This fin seal seam may join without any transition a second tubular body, which is also formed by this and is arranged parallel and next to the first tubular body. In this way, it becomes possible to manufacture several tubular receptacles arranged side by side, which are connected to each other via a fin seal seam. The fin seal seam can be perforated parallel to the longitudinal extension of the tubular receptacle, so that one tubular receptacle can be separated from the one arranged adjacent to it. In this way, it is possible to realize a "six pack", for instance.

In another alternative embodiment, the tubular body is constructed to be seamless. This may be realized by extrusion. The individual layers of the laminate are preferably co-extruded according to the invention. On this occasion, tandem, one-step or triplex extrusion is possible.

The at least one barrier coating contained in the laminate may be manufactured from one or more of the following materials: polyethylene terephthalate silicon oxide (PET-SiOx), stretched polyamide (OPA-SiOx), ethylene-vinyl alcohol (EVOH), polyamide (PA), aluminum, especially aluminum foil.

The thickness of the laminate is, according to the invention, in the range of 450 μm to 800 μm, preferably in the range of 250 μm to 400 μm and, above all, preferably in the range of 150 μm to 200 μm.

The laminate according to the invention may contain one or more barrier coatings, which may be manufactured from the same material, though preferably from different materials.

In one embodiment of the invention, the closure device can be fastened on the top section, especially on a collar-shaped part of the top section, by means of mounting, screwing or clicking on. However, it is equally possible to glue the closure device on the top section or a collar-shaped part of this or to seal it with the latter. The fastening variant applied in each case depends on the desired load-bearing capacity of the connection between closure device and top section, and possibly the desired refill capacity of the receptacle. Hence it is advantageous, for instance, to attach a screw-type closure device if carbonated drinks are filled and stored in the tubular can-shaped receptacles since this guarantees both a deliberate relief of pressure and a secure seal.

In a further embodiment of the invention, the base section has a sealable and/or resealable facility, allowing the receptacle to be filled one or more times. As an alternative to this, the filling process can be carried out through the top section, preferably before the closure device is fastened on. Repeated filling through the top section may be carried out through the open closure device. Alternatively, a closure device may be used that can be mounted, screwed or clicked on to the top section and removed again in reverse fashion.

In addition, the aim according to the invention may be achieved by a method of manufacturing a tubular, especially can-shaped, receptacle for the accommodation of fluids, especially drinks, with a tubular body and a base and top section attached to this, wherein a shoulder-shaped top section is inserted in the tubular body and sealed with this in such a way that the shoulder-shaped top section is at least partially enclosed, especially in the shape of a shoulder, by an upper edge of the tubular body. The shoulder-shaped top section here may be inserted through the opening in the base of the tubular body and displaced longitudinally as far as an opening in the head of the tubular body. Alternatively, an upper edge of the tubular body may only be deformed into the shape of a shoulder when the shoulder-shaped top section has been inserted in the head of the tubular body. Such a shoulder-shaped deformation of the upper edge of the tubular body may be carried out, for instance, in the course of sealing. Sealing the shoulder-shaped top section with the upper edge of the tubular body is also carried out, of course, if the shoulder-shaped top section is inserted in the same through the opening in the base of the tubular body and displaced in the direction of the head of the tubular body.

In another embodiment of the invention, a circular base section is inserted in the tubular body and sealed with this in such a way that the circular base section is enclosed by a lower edge of the tubular body. The lower edge at least of the tubular body is sealed on this occasion with a sealed part of the circular base section running parallel to the edge.

The circular base section is preferably dimensionally stable, though it may also be constructed to be flexible. A dimensionally stable construction here guarantees, in an advantageous manner, a stable standing surface for the tubular receptacle. The advantage of a flexible construction to the circular base section, in contrast, consists in an improved ability to be folded up and disposed of when the receptacle is empty and has to be discarded.

The tubular body may be manufactured from a laminate that has at least one barrier coating, which may consist of the aforementioned materials. Depending on the requirement, several barrier coatings may also be arranged in the laminate.

In another embodiment of the invention, the tubular body is manufactured by means of extrusion. This enables a seamless manufacture of the tubular body and thus greater firmness. The preferred manufacture of the tubular body is as a lap-seal sealed laminate, wherein the sequence of layers of the laminate is as follows: sealing layer/barrier coating/sealing layer. Polyethylene (PE) or polypropylene (PP) or similar sealable materials are preferably used for the sealing layer.

A printing of the tubular receptacle may be carried out on the outer sealing layer or on a transparent barrier coating, such as a barrier containing polyethylene terephthalate.

Hence, embodiments of the tubular receptacle are suitable for filling and storing as well as transporting fluids, especially still drinks or slight to minimally carbonated drinks. The tubular receptacle can be sterilized or pasteurized. Filling can be carried out through the open base and subsequent sealing or through an opening in the base or through the shoulder-shaped top section.

In addition, the aim of the invention is achieved by the use of a tubular, especially can-shaped, receptacle consisting of at least one tubular body and a base and shoulder-shaped top section attached to this for fluids that are under slight excess pressure, especially carbonated drinks.

BRIEF DESCRIPTION OF THE FIGURES

Below the invention is described from one embodiment example, which is explained in more detail from the figure.

DETAILED DESCRIPTION

Figure 1:
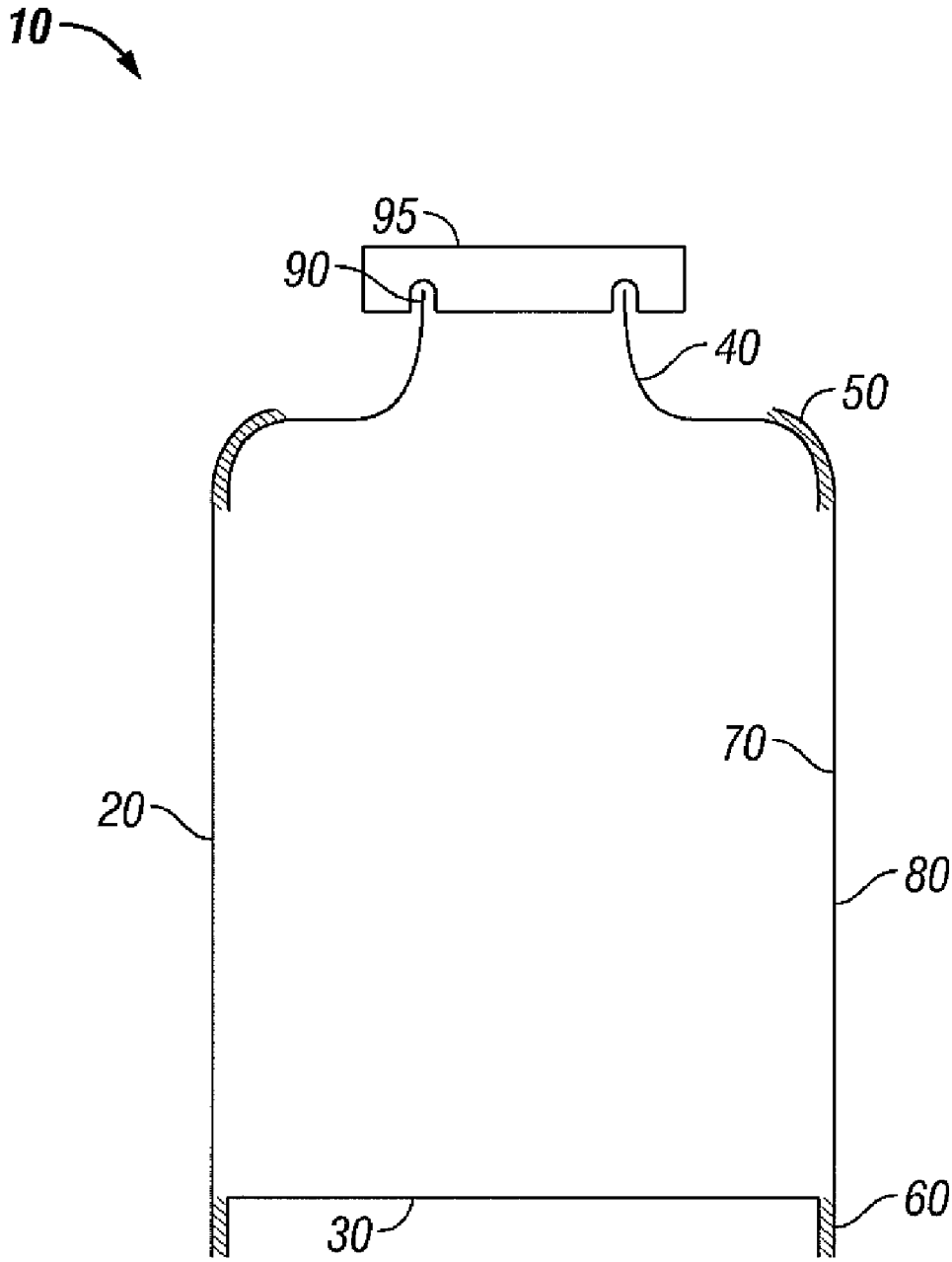
FIG. 1: A schematic representation of a tubular receptacle according to the invention according to a preferred embodiment

In the following description the same reference numerals are used for the same and similarly acting parts.

FIG. 1 depicts a tubular receptacle 10. The tubular receptacle has a tubular body 20 and a base section 30 and a shoulder-shaped top section 40. The base 30 is inserted in the tubular body 20 from below and is sealed along a lower edge 60 with the tubular body 20. In the head of the tubular body 20 the shoulder-shaped top section 40 with a collar-shaped part 90 is located. The shoulder-shaped top section

40 is sealed with an upper edge 50 of the tubular body 20. The upper edge 50 encloses the shoulder-shaped top section 40 in the shape of a shoulder. The tubular body 20 is manufactured from a laminate, which has a barrier coating (not depicted). The layer 70 of the laminate facing the inside of the receptacle consists of polyethylene. The layer 80 of the laminate facing the outside of the receptacle also consists of this material. The same layer structure applies to the base section as to the shoulder-shaped top section 40. In this way it is guaranteed that the outer layers of the laminate consist of a sealable material and, as a result, that the base section 30 and the top section 40 can be inserted in the tubular body 20. A closure device 95 can be fastened to the collar-shaped part 90 of the tubular receptacle 10.

At this point it should be pointed out that all the parts described above have been claimed for themselves alone and in any combination, especially the details described in the drawing. Revisions to this are familiar to the man skilled in the art.

LIST OF REFERENCE NUMERALS

10 tubular receptacle
20 tubular body
30 base section
40 top section
50 upper edge
60 lower edge
70 layer of laminate facing the inside of the receptacle
80 layer of laminate facing the outside of the receptacle
90 collar-shaped part

What is claimed is:

1. A receptacle for accommodating fluids, said receptacle consisting essentially of:

a top section comprising a shoulder at a lower portion thereof and an opening at an upper portion thereof;

a closure device configured to cover and seal the opening in the top section;

an inflexible base section comprising an edge area forming a sealing edge having a width extending horizontally to the circumference of 0.25 mm to 5 mm;

a flexible tubular body comprising a laminate material;

wherein an upper edge of said tubular body surrounds and is sealed to said shoulder portion of said top section by a lap seam; and wherein a lower edge of said tubular body surrounds and is sealed to the edge area of the inflexible base section by another lap seam, wherein the lap seam at the base section is formed without longitudinal folds back around the edge area of the inflexible base section and does not extend past the edge area of the inflexible base section.

2. The receptacle of claim 1, wherein the thickness of the flexible laminate tubular body is less than 400 μm.

3. The receptacle of claim 2, wherein the thickness of the sealing edge of the flexible base is greater than 400 μm.

4. The receptacle of claim 1, wherein the tubular body is seamless.

5. The receptacle of claim 1, wherein a layer of the laminate facing one inner side of the receptacle is constructed as a sealing layer and a layer of the laminate facing one outer side of the receptacle is constructed as a printable and/or sealable layer.

6. The receptacle according to claim 1, wherein the closure device on the top section can be fastened by means of mounting, screwing or clicking on.

7. The receptacle according to claim 1, wherein the base section has a sealable and/or resealable facility, allowing the receptacle to be filled one or more times.

8. The receptacle according to claim 1, wherein the laminate material comprises a barrier layer.

9. The receptacle according to claim 8, wherein the barrier layer comprises one or more of the following materials: polyethylene terephthalate silicon oxide (PET-SiOx), stretched polyamide (OPA-SiOx), ethylene-vinyl alcohol (EVOH), polyamide (PA), and aluminum (Al).

* * * * *